US007097147B2

(12) United States Patent
Shaw et al.

(10) Patent No.: US 7,097,147 B2
(45) Date of Patent: Aug. 29, 2006

(54) NON-DESTRUCTIVE FORM BRACKETS AND METHODS OF USING THE SAME

(76) Inventors: Lee A. Shaw, 2672 Crestview Dr., Newport Beach, CA (US) 92663; Ronald D. Shaw, 1401 Outrigger, Corona Del Mar, CA (US) 92625

( * ) Notice: Subject to any disclaimer, the term of this patent is extended or adjusted under 35 U.S.C. 154(b) by 0 days.

(21) Appl. No.: 10/818,761

(22) Filed: Apr. 6, 2004

(65) Prior Publication Data

US 2005/0218277 A1 Oct. 6, 2005

(51) Int. Cl.
*E04G 17/00* (2006.01)

(52) U.S. Cl. ..... 249/208; 249/210; 249/207.2; 249/207.3; 248/201; 52/169.7; 52/169.8

(58) Field of Classification Search ..... 249/205, 249/207, 219.1, 167, 219.2, 210, 207.2, 207.3, 249/207.4, 207.5, 207.6, 207.7, 208; 52/712, 52/715, 169.7, 169.8; 248/250, 201, 235
See application file for complete search history.

(56) References Cited

U.S. PATENT DOCUMENTS 1,690,295 A * 11/1928 Heltzel ..... 249/6
4,339,106 A * 7/1982 Navarro ..... 249/219.1
4,393,568 A * 7/1983 Navarro ..... 29/432
4,723,752 A * 2/1988 Thomas ..... 249/219.1
5,522,579 A * 6/1996 Rock ..... 249/219.1
5,817,247 A * 10/1998 Colatruglio ..... 249/4
6,230,451 B1 * 5/2001 Stoller ..... 52/169.1
6,540,201 B1 * 4/2003 Gagnon et al. ..... 249/139
2002/0062603 A1 * 5/2002 Shaw et al. ..... 52/125.1

OTHER PUBLICATIONS

White Cap Industries, "Simpson SBV Shelf Brackets", p. 607 from catalog.
Aztec Concrete, "Nail-Less Tilt-Panel Forming System", page from magazine.
Tilt-UP Concrete Association, vol. II, No. 4, "Panel Trak", p. 6, advertisment in magazine.
Simpson Strong-Tie, "SBV/CF-R Shelf Brackets/Concrete Form Angles", page from website.

* cited by examiner

*Primary Examiner*—Kimberly Wood
(74) *Attorney, Agent, or Firm*—Stetina Brunda Garred & brucker

(57) ABSTRACT

A non-destructive form bracket assembly and method of using the same is provided including a bracket having a vertical supporting side and horizontal supporting side for maintaining a form vertically upright; an attachment device having a first and second foundation attachment portion. The attachment device is adapted for engaging a portion of said bracket for non-destructively affixing the bracket to a foundation. Adhesive is affixed to bottom surfaces of the first and second foundation attachment portions for adhering the attachment to the foundation. Additionally, a non-destructive form assembly utilized in tilt-up construction for a double-side pour process is provided comprising a form and a plurality of U-shaped single rail brackets installed on a bottom edge of the form in spaced intervals with pre-applied adhesive on the bottom of the brackets.

22 Claims, 4 Drawing Sheets

NON-DESTRUCTIVE FORM BRACKETS AND METHODS OF USING THE SAME

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Field of the Invention

The present invention relates to tilt-up construction. In particular, the present invention relates to brackets used to support form sides. And in more particularity, the present invention relates to non-destructive form brackets which eliminate the use of concrete nails as a means of attaching form brackets to the floor slab or foundation.

2. Background of the Invention

Tilt-up construction is one of the fastest growing industries in the United States. At least 10,000 buildings enclosing more than 650 million square feet are constructed annually. This is due, in part, to the economics of tilt-up, which combine reasonable cost with low maintenance, durability, speed of construction, and minimal capital investment. The tilt-up process requires few forms and makes efficient use of modern mechanical equipment. Ready mixed concrete for tilt-up is locally available and special labor skills are not required. Panels are formed and cast on the jobsite, and can be quickly tilted, lifted, set in place, and braced with the aid of high capacity mobile cranes.

Simplicity is the key to tilt-up concrete construction. Panels are cast as near to their final position as possible. The most convenient casting base is most often the concrete floor slab of the building. Wood or steel edge forms are prepared and positioned on the casting base. Reinforcing steel, vapor seal, insulation, door and window frames, electric conduit, and outlet boxes are then positioned. Wall panels are cast on the horizontal base, cured, tilted into a vertical position and moved into place with a mobile crane.

The standard practice in laying out panels is to snap a chalk line on the floor slab. These lines indicate panel perimeters and the forms are placed against them. Wood 2×s are the most common material used for side forms. Often the panel depth is designed to fit the depth of standard dimension lumber, so 5½" (a.k.a. "6×s") and 7¼" (a.k.a. "8×s") structural panels are common. Typically, the form sides are supported and secured to the foundation by a wood or steel angle support. Any common concrete anchor can be used to attach forms to the foundation. For instance, it is most common to pneumatically drive concrete nails using a nail gun into the foundation.

Although tilt-up construction does have many advantages, there are some aspects of tilt-up construction which can still use some refinement. Most noticeable is the damage that is inflicted to the top of the foundation from the nails or concrete anchors that are driven into the foundation or floor slab. Typically, an area where the nail was embedded must be patched. Not only are the patches unsightly, but the damage inflicted into the concrete wall can be harmful to the structural integrity of the concrete structure. Also, many times a water membrane barrier is laid down in the foundation and the nails penetrate the membrane.

It would be advantageous to provide a bracketing system which is non-destructive to the foundation or floor slab of which tilt-up panels are formed. Ideally, the bracketing system would be simple to use and inexpensive. It would further be advantageous to provide an attachment plate or piece which could be retrofitted or designed to be used in conjunction with existing angles brackets, such SIMSPON "Strong Tie" brackets.

BRIEF SUMMARY OF THE INVENTION

The present invention, a non-destructive form bracket assembly utilizes a self-adhesive attachment plate to hold down common angle brackets for edge form construction. The system may be used on a variety of foundations or sub-surfaces such concrete, waterproofing, drain board, tile, granite, finished surfaces to fasten any hold edge forms for concrete construction. The non-destructive bracket assembly includes an attachment plate or block having foundation attachment portions.

An advantage of the non-destructive form bracket assembly is that it requires no drilling or driving of fastening hardware such as nails into existing foundation surfaces. As a result, structural damage to the foundation can be effectively eliminated. Another advantage of the present invention is that it utilizes readily available existing brackets to save manufacturing and tooling costs. A further advantage of the non-destructive form bracket is that the form can be aligned to snap line or layout with the brackets pre-installed. As a result, another advantage of the present invention is that the brackets can stay on the forms for re-use. Additionally, a single rail bracket may be used to secure single rail tilt-up forms without drilling slabs.

According to a first embodiment of the present invention, a non-destructive form bracket assembly is provided. The bracket assembly comprises a bracket having a vertical supporting side and horizontal supporting side for maintaining a form vertically upright; an attachment device having a first and second foundation attachment portion. The attachment device is adapted for engaging a portion of the bracket for non-destructively affixing the bracket to a foundation. Adhesive is affixed to bottom surfaces of the first and second foundation attachment portions for adhering the attachment to the foundation.

According to another aspect of the present invention, the bracket comprises a triangular shaped gusset attached to the vertical supporting side and the horizontal supporting side, a hypotenuse side interconnecting the vertical and horizontal supporting sides. The gusset has a triangular void therethrough such that a horizontally oriented raised gusset edge is formed directly above the horizontal supporting side. A mounting tab is formed contiguously along each of the vertical and horizontal supporting sides, and the mounting tabs are oriented at right angles relative to the gusset and having a plurality of mounting holes.

According to another aspect of the present invention, the bracket comprises a SIMPSON concrete form angle. Furthermore, the attachment device may comprise an attachment plate adapted to hold the horizontally oriented raised gusset edge downward towards the foundation.

According to another aspect of the present invention, the attachment plate comprises an inclined portion connected to the first foundation attachment portion, a vertical portion connected to the inclined portion forming a retaining edge positioned within a triangular shaped recess, and second foundation attachment portion connected to the vertical portion such that the first and second attachment portions are oriented in a same plane.

According to another aspect of the present invention, the attachment plate is adapted to be transversely positioned over the horizontally oriented raised gusset edge such that the retaining edge engages the raised gusset edge. Furthermore, the mounting tab formed on the horizontal supporting side fits within the triangular shaped recess without obstruction.

According to another aspect of the present invention, the attachment device comprises an attachment block adapted to hold the horizontally oriented raised gusset edge downward toward the foundation. Moreover, the attachment block comprises first and second foundation attachment portions having a gusset edge receiving groove and a mounting tab recess formed between the first and second foundation attachment portions. Also, the attachment block is adapted to be transversely positioned over the horizontally raised gusset edge such that the receiving groove engages the raised gusset edge. Furthermore, the attachment block may be manufactured from one of wood, plastic, rubber and metal. According to yet another aspect of the present invention, the adhesive comprises double-sided tape.

According to a second embodiment of the present invention, a form assembly for tilt-up construction is provided. The form assembly comprises a form defining a backside face, frontside face, an upper edge and a lower edge. A plurality of non-destructive form bracket assemblies attached to the backside face of the form and spaced apart in intervals. The bracket assemblies comprise a bracket having a vertical supporting side and horizontal supporting side. The vertical supporting side is attached to the backside face for maintaining the form vertically upright. An attachment device having a first and second foundation attachment portion is provided for engaging a portion of the bracket for non-destructively affixing the bracket to a foundation. Adhesive is affixed to bottom surfaces of the first and second foundation attachment portions for adhering the first and second foundation attachment portions to a foundation.

According to another aspect of the present invention, the form comprises conventional sized precut lumber having standard dimensions comprising one of a "1×6", "1×8", "2×6" and "2×8".

Moreover, a method of assembling forms with a plurality of non-destructive bracket assemblies is provided according to an aspect of the present invention. The method comprises positioning the plurality of brackets in an upright vertical manner in spaced apart intervals alongside a backside of a form; attaching the mounting tabs formed on the vertical supporting sides of the brackets to the backside of the form with fastening hardware; aligning a front face of the form on a layout line; positioning the attachment plates transversely over the raised gusset edge such that the retaining edge engages the horizontally oriented raised gusset edge; and affixing the adhesive to a top surface of a foundation.

Another method of assembling forms with a plurality of non-destructive bracket assemblies is provided according to an aspect of the present invention. This method comprises positioning the plurality of brackets in an upright vertical manner in spaced apart intervals alongside a backside of a form; attaching the mounting tabs formed on the vertical supporting sides of the brackets to the backside of the form with fastening hardware; aligning a front face of the form on a layout line; positioning the attachment blocks transversely over the raised gusset edge such that the receiving groove engages the horizontally oriented raised gusset edge; and affixing the adhesive to a top surface of a foundation.

According to a third embodiment of the present invention, a non-destructive form assembly utilized in tilt-up construction for a double-side pour process is provided. The form assembly comprises a form and a plurality of U-shaped single rail brackets installed on a bottom edge of said form in spaced intervals. The single rail brackets consist of a horizontally oriented planar foundation attachment portion disposed between two opposing vertically oriented sidewall portions. Also an adhesive on the bottom of the foundation attachment portion is pre-applied.

Additionally, a method is provided for assembling a non-destructive form utilized in tilt-up construction for a double-side pour process. The method comprises installing a plurality of U-shaped single rail brackets on a bottom edge of the form in spaced intervals; attaching the plurality of U-shaped single rail brackets to the form with fasteners; aligning the form on a layout line; and affixing an adhesive previously applied to a bottom of the U-shaped single rail brackets to a top surface of a foundation. Also the method may include applying pressure to a top edge of the form to ensure the adhesive affixes to the foundation.

Other exemplary embodiments and advantages of the present invention may be ascertained by reviewing the present disclosure and the accompanying drawings.

BRIEF DESCRIPTION OF THE DRAWINGS

The present invention is further described in the detailed description that follows, by reference to the noted drawings by way of non-limiting examples of preferred embodiments of the present invention, in which like reference numerals represent similar parts throughout several views of the drawings, and in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Prior Art SIMPSON Bracket

Figure 1A:
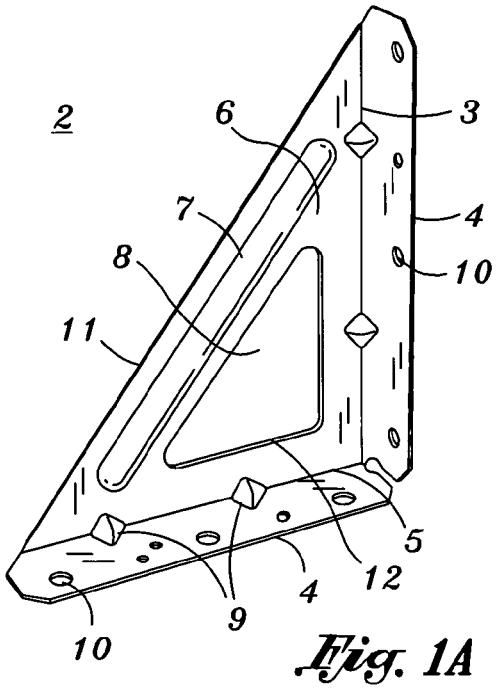
Fig. 1A (PRIOR ART)
FIG. 1A illustrates a rightside perspective of a prior art SIMPSON "Strong Tie CF" bracket.
Figure 1B:
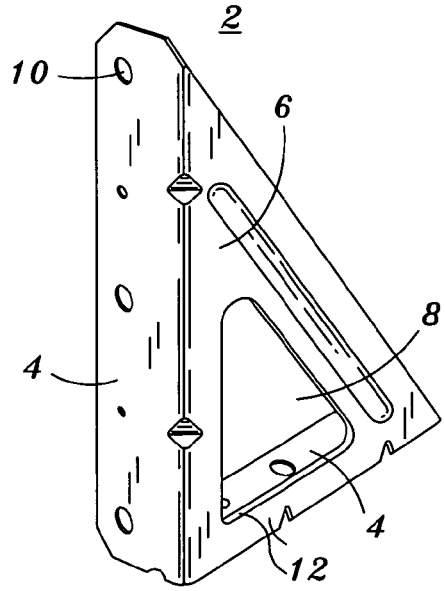
Fig. 1B (PRIOR ART)
FIG. 1B illustrates a leftside mounting side perspective of a prior art SIMPSON "Strong Tie CF" bracket.

FIG. 1A illustrates a rightside perspective of an exemplary prior art SIMPSON "Strong Tie CF" bracket 2; while FIG. 1B illustrates a mounting side perspective of the same prior art SIMPSON "Strong Tie CF" bracket 2. The SIMPSON bracket 2 is formed from galvanized coated 16 gauge sheet metal. A gusset 6 is provided having a triangular shape with a 6 inch supporting side 3, a 5 inch supporting side 5, and a 7½ inch hypotenuse side 11, resulting in a 40–50–90 degree proportioned triangle. It is further acknowledged that the SIMPSON bracket may have varying dimensions and proportioned sides, however, which perform the same similar function as the exemplary SIMPSON "Strong Tie" bracket 2 described herein the instant specification. Each supporting side 3, 5 has a mounting tab formed 4 thereon with a plurality of mounting holes 10. To provide strength to the bracket 2, a plurality of strengthening notches 9 are provided between the gusset supporting sides 3, 5 and the mounting tabs 4. Also a strengthening rib 7 is formed on the hypotenuse side 11. A triangular hole 8 is formed within the gusset 6 which defines a raised horizontal gusset edge 12.

Figure 2:
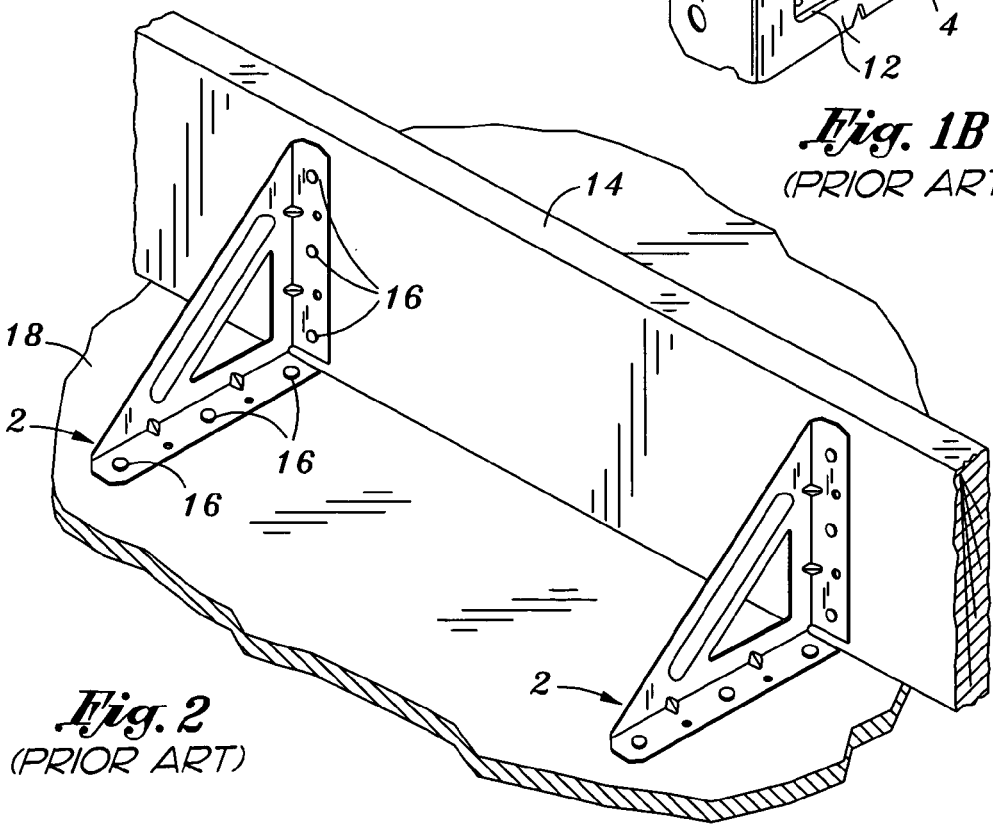
Fig. 2 (PRIOR ART)
FIG. 2 illustrates a rightside perspective of a plurality of prior art SIMPSON "Strong Tie" brackets utilized in a typical form installation.

FIG. 2 illustrates a rightside perspective of a plurality of prior art SIMPSON "Strong Tie" brackets 2 utilized in a typical form installation. The typical form installation is constructed atop of a foundation 18 of the building being erected. In a typical installation, a SIMPSON bracket 2 or other bracket serving the same function is fastened with concrete nails 16 to the form 14 and to the foundation 18. The form material 14 is typically precut lumber having the standard dimensions of 1"×6", 1"×8", 2"×6" or 2"×8" depending on the thickness of the wall to be formed. The spacing between each bracket 2 is typically, 36" for 2×'s and 18" for 1×'s. Moreover, when the SIMPSON bracket 2 is utilized, either the 5 inch supporting side or the 6 inch supporting side may be used as the vertical support side depending on the whether a 6" tall or 8" tall form is being utilized. The main disadvantage of the aforementioned process for forming tilt-up concrete walls, is that the nails 16 are driven directly into the concrete foundation 18. As a result, structural damage from the nails 16 to the foundation 18 is common.

FIRST EMBODIMENT OF THE PRESENT INVENTION

Figure 3A:
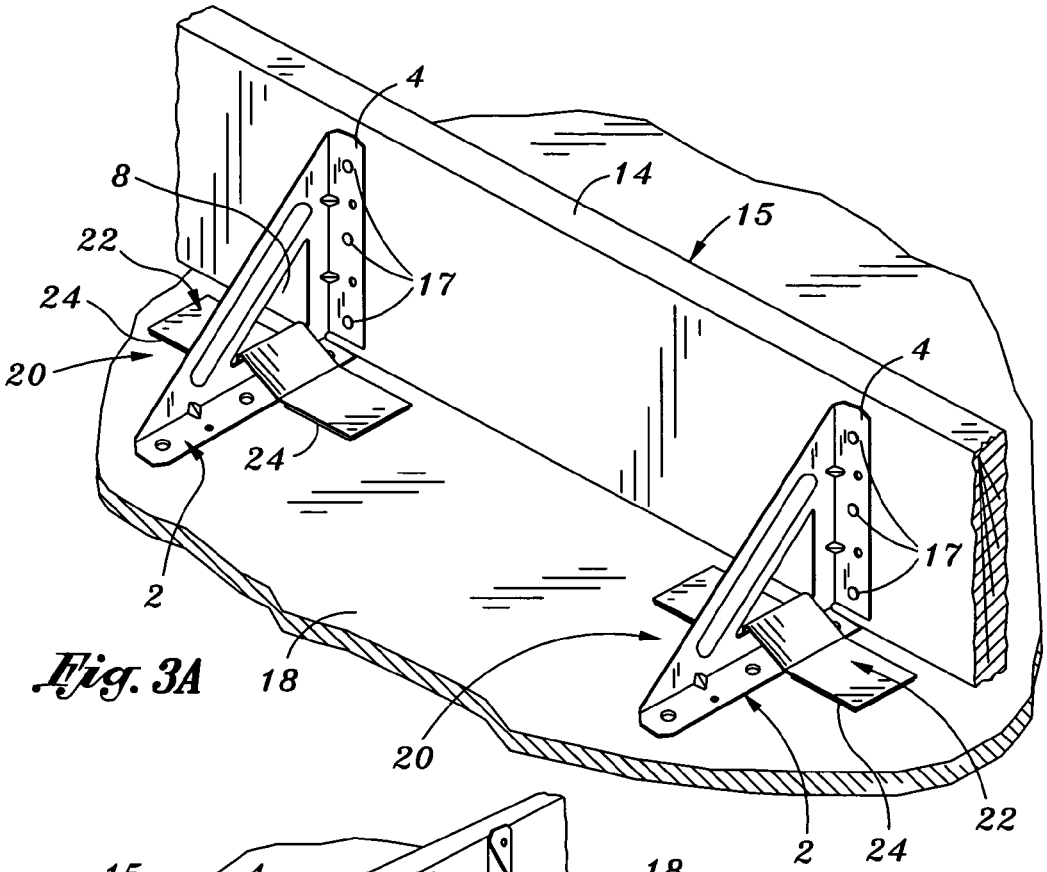
FIG. 3A illustrates a rightside perspective of a plurality of non-destructive form bracket assemblies utilized in a form installation, according to an aspect of the present invention.
Figure 3B:
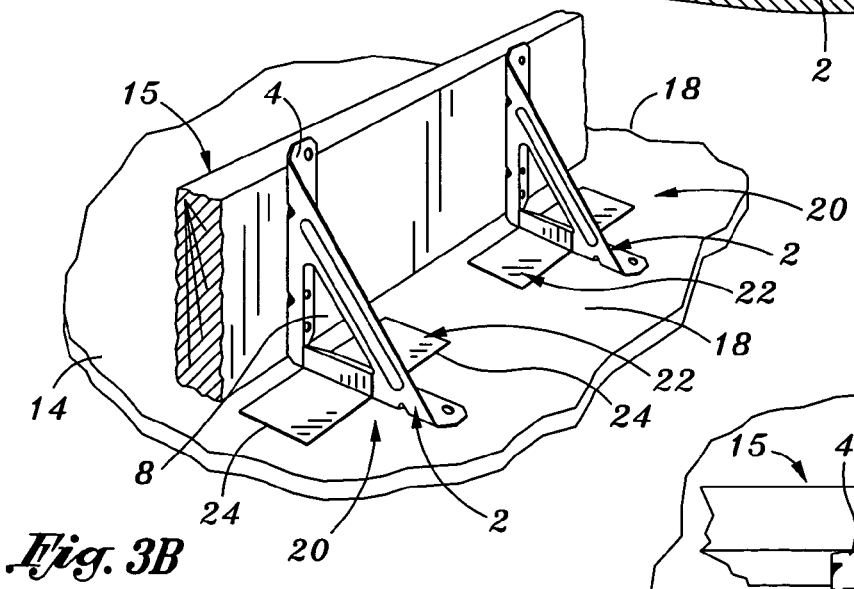
FIG. 3B illustrates a leftside perspective of a plurality of the non-destructive form bracket assemblies utilized in a form installation, according to an aspect of the present invention.

FIGS. 3A–B illustrate rightside and leftside perspective views of a plurality of non-destructive form bracket assemblies 20 utilized in a form installation, according to a first embodiment of the present invention. Also FIG. 3C is provided to illustrate a top view perspective of the non-destructive form bracket assembly 20 utilized in the form installation, according to the first embodiment of the present invention.

Figure 4A:
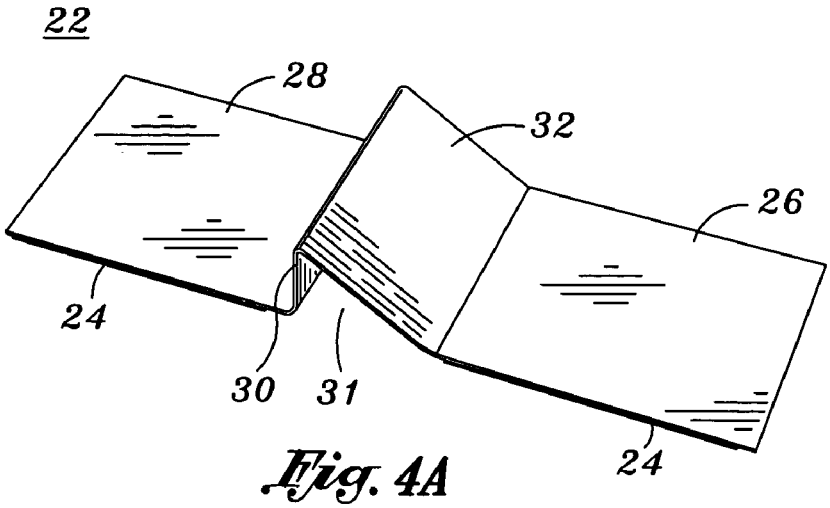
FIG. 4A illustrates a top view perspective of an attachment plate, according to an aspect of the present invention.
Figure 4B:
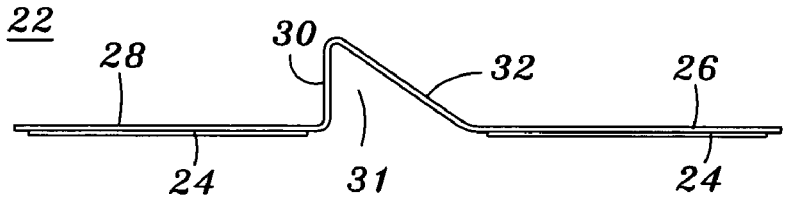
FIG. 4B illustrates a side view perspective of the attachment plate, according to an aspect of the present invention.
Figure 4C:
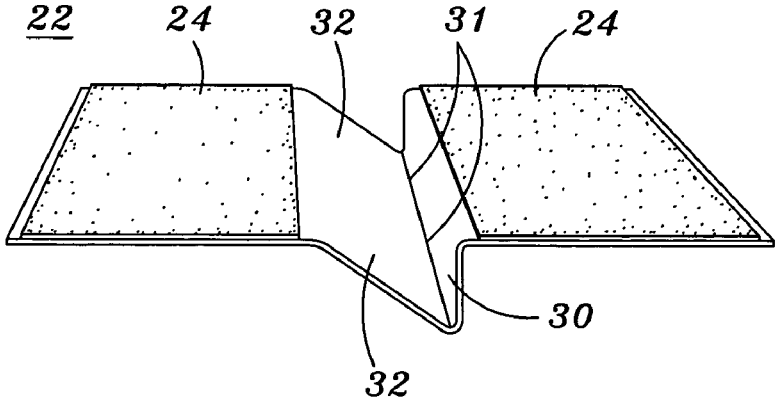
FIG. 4C illustrates a bottom view perspective of the attachment plate, according to an aspect of the present invention.

The non-destructive form bracket assembly 20 comprises a prior art SIMPSON bracket 2 and an attachment plate 22. FIG. 4A illustrates a top view perspective of an attachment plate 22, FIG. 4B illustrates a side view perspective of the attachment plate and FIG. 4C illustrates a bottom view perspective of the attachment plate, according to an aspect of the present invention.

The attachment plate 22 plate may be formed from sheet metal, preferably galvanized. The attachment plate 22 includes a first planar foundation attachment portion 26, an inclined portion 32, a vertical portion 30, and a second planar foundation attachment portion 28. As a result of the bent shape of the attachment plate 22, a triangular shaped gusset edge receiving recess 31 is formed which is adapted to receive a raised horizontally oriented gusset edge 12 (see FIGS. 1A–B). For fastening the first and second foundation attachment portions 26, 28 to the foundation 18, double-sided adhesive strips 24 are applied to the bottom faces of the foundation portions 26, 28. Before the foundation portions 26, 28 are applied to the foundation 18, a cover sheet or the like is peeled from the adhesive strips 24. The details of the method of installing the attachment plate will be further elaborated later in the specification.

Figure 3C:
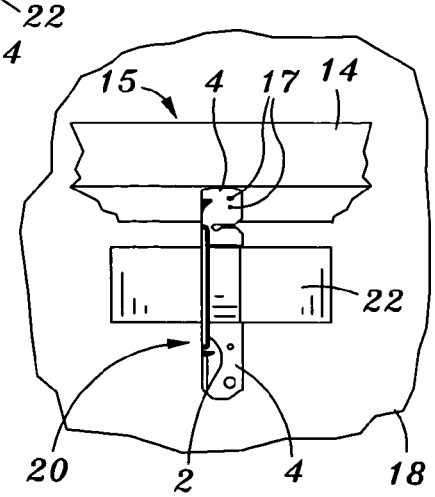
FIG. 3C illustrates a top view perspective of the non-destructive form bracket assembly utilized in a form installation, according to an aspect of the present invention.

As shown in FIGS. 3A–C, the attachment plate 22 is positioned within the triangular hole 8, such that the raised horizontal gusset edge 12 is received into the receiving recess 31 of the attachment plate 22. It is note that the base of the triangular-shaped recess is dimensioned such that the recess 31 will have sufficient clearance to receive the mounting tab 4 positioned above and directly interfacing the foundation 18.

Figure 5A:
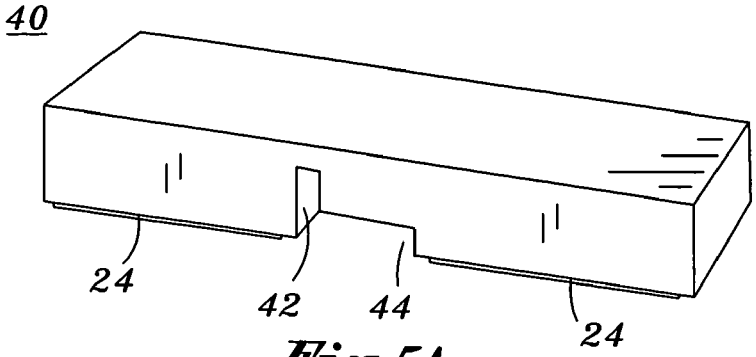
FIG. 5A illustrates top view perspective of an attachment block which is an alternative embodiment of the attachment plate, according to an aspect of the present invention.
Figure 5B:
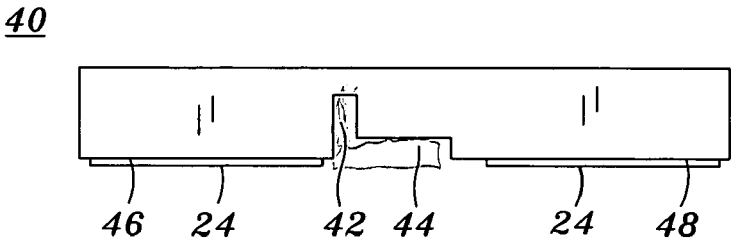
FIG. 5B illustrates side view of the attachment block, according to an aspect of the present invention.

FIGS. 5A–B illustrate a top view perspective and side view of an attachment block 40 which is an alternative embodiment of the attachment plate, according to an aspect of the present invention. The attachment block 40 may be manufactured from a variety of material, such as wood, plastic, rubber, metal. Disposed in the attachment block 40 is a gusset edge receiving groove 42 which is adapted to receive the raised horizontal gusset edge 12. In the same general region, a mounting tab recess 44 is provided to receive the mounting tab 4 positioned above and directly interfacing the foundation 18. Moreover, each attachment block 40 is provided with a first attaching surface 46 and a second attaching surface 48 further having double-sided adhesive strips 24. Before the foundation portions 46, 48 are applied to the foundation 18, a cover sheet or the like is peeled from the adhesive strips 24. The details of the method of installing the attachment plate will be further elaborated later in the specification.

It is acknowledged that the bracket 2 utilized with the attachment plate 22 or the attachment block 40 may be a bracket other than the SIMPSON "Strong Tie CF" bracket 2. For instance, an attachment plate 22 or attachment block 40 may be configured to secure numerous well-known brackets to the foundation 18 in a non-destructive manner. Thus, the present invention should not be limited to assemblies which only use SIMPSON "Strong Tie CF" brackets 2.

METHOD OF USING THE FIRST EMBODIMENT

A method of using the non-destructive form bracket assembly 20 is also herein provided. The SIMPSON brackets 2 may be installed onto the form 14 prior to laying out the lines of the tilt-up walls on the foundation 18. An exemplary installation shown in FIGS. 3A–C. Before attachment, the vertically oriented tab 4 is positioned plum and squarely adjacent the form 14. Then the bracket 2 is secured to the form 14 by fasteners, such as nails, screws or any other fasteners 16 known in the art for attaching brackets 2 to the forms 14. If 2×'s are being used for the forms 14, it is recommended that the spacing between brackets 2 is about 36". If 1×'s are being used for the forms 14, it is recommended that the spacing between brackets is about 18". Moreover, if the form is 6" wide lumber, it is recommended that the mounting tab 4 from the 5" supporting side 5 be attached to the vertical face of the form. Or, if the form is 8" wide lumber, it is recommended that the mounting tab 4 from the 6" supporting side 3 be attached to the vertical face of the form. However, it is acknowledged that since the forms 14 may comprise material other than conventional precut lumber having the standard dimensions of 1"×6", 1"×8", 2"×6" or 2"×8", that the spacing of the brackets 2 and choice of which side 3, 5 of the bracket 2 which is attached directly to the form 14, may vary depending on the application.

Once the brackets 2 are attached to the forms 14, the forms 14 with brackets 2 attached may be positioned according to the layout lines of the tilt-up wall to be formed. In particular, the form face 15 (the vertical side of the form without the brackets 2) should be positioned directly above or near the layout line. Once the form 14 is properly aligned along the layout line, the attachment plates 22 or attachment blocks 40 may be installed onto/into the brackets 2. First, the cover from the adhesive strips 24 is removed. As shown in exemplary FIGS. 3A–C, the attachment plate 22 or attachment block 40 (not shown) is positioned over the raised horizontal gusset edge 12 such that the gusset receiving recess 31 or gusset receiving recess 42 receives the gusset edge 12 formed on the bracket 2. Moreover, the base of the triangular recess 31 or the mounting tab recess 44 is adapted to receive the mounting tab 4 that is horizontally disposed along the foundation. Then sufficient pressure should be applied to the foundation attachment portions 26, 28 or 46, 48 such that the adhesive strips 24 properly stick to the upper surface of the foundation 18. As a result, the adhesive strips 24 anchors the attachment plates 22 or the attachment block 40 securely over the raised horizontal gusset edge 12. Once the forms 14 are secured to the foundation 18 in the proper positions, then pouring of the concrete may commence. After the concrete has hardened, the attachment plate 22 or attachment block 40 may be removed using conventional tools. Since the brackets 2 remain installed undamaged on the form 14, it is not necessary to reinstall the brackets 2. Rather, the form 14 only needs to be moved to another layout line and only the attachment plates 22 or attachment blocks 40 need to be reapplied.

SECOND EMBODIMENT OF THE PRESENT INVENTION

Figure 6A:
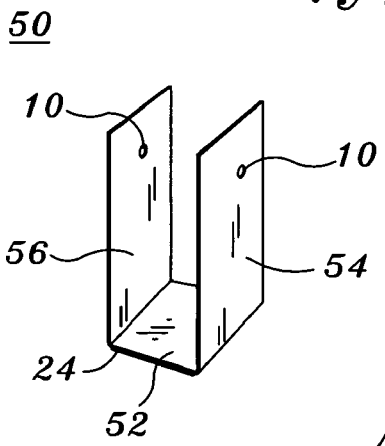
FIG. 6A illustrates top view perspective of a single rail bracket, according to an aspect of the present invention.

FIG. 6A illustrates top view perspective of a second embodiment of a non-destructive form bracket which is a single rail bracket 50, according to an aspect of the present invention. The single rail bracket 50 is a basic U-shaped bracket having a horizontally oriented planar foundation attachment portion 52 disposed between two opposing vertically oriented sidewall portions 54, 56. The foundation attachment portion 52 has a width which is adapted to accept a standard cut lumber such as 2×'s or 1×'s. A plurality of mounting holes 10 are disposed on the vertically oriented sidewall portions 54, 56 which are adapted to receive fastening hardware such as nails or screws 16. On the bottom of the foundation attachment portion 52, a double-sided adhesive strip 24 is applied to the bottom face of the foundation attachment portions 52. Before the foundation portion 52 is applied to the foundation 18, a cover sheet or the like is peeled from the adhesive strip 24. The details of the method of installing the attachment plate will next be discussed below.

Figure 6B:
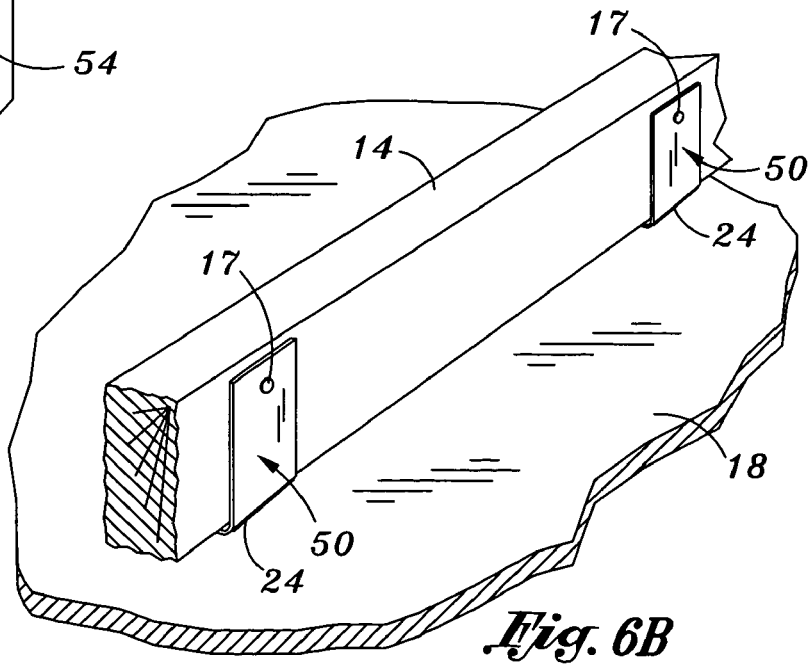
FIG. 6B illustrates top view perspective of a plurality of single rail brackets utilized in a form installation, according to an aspect of the present invention.

FIG. 6B illustrates top view perspective of a plurality of single rail brackets 50 utilized to hold a form 14 upright, according to an aspect of the present invention. The second embodiment single rail bracket 50 may be utilized in double pouring situations. In this scenario, a tilt-up wall is formed on both sides of the form 14. Initially, the single rail brackets 50 are installed onto the form edge using conventional fasteners 16 such as nails. Next, the covers of the adhesive strips 24. Then, the form 14 is positioned over the layout line such that the planar foundation attachment portions 52 are positioned on the foundation. Finally, pressure should be applied to the top of the form such that the adhesive strips 24 properly attach to the top of the foundation 18. Once the tilt-up walls are poured and the concrete has hardened, the form 14 with the plurality of single rail brackets 50 can then be pulled or removed from the tilt-up walls while they are still horizontally disposed on the foundation.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed; rather, the invention extends to all functionally equivalent structures, methods, and such uses are within the scope of the appended claims.

What is claimed is:

1. A non-destructive form bracket assembly comprising:

a bracket having a vertical supporting side and horizontal supporting side for maintaining a form vertically upright, said bracket including a triangular shaped gusset attached to said vertical supporting side and said horizontal supporting side, a hypotenuse side interconnecting said vertical and horizontal supporting sides, said gusset having a triangular void there through such that a horizontally oriented raised gusset edge is formed directly above said horizontal supporting side, and a mounting tab formed contiguously along each of said vertical and horizontal supporting sides, said mounting tabs oriented at right angles relative to said gusset and having a plurality of mounting holes;

an attachment device having first and second foundation attachment portions and a receiving recess being interposed therebetween, said receiving recess being adapted for engaging a portion of said bracket for non-destructively affixing said bracket to a foundation with said bracket being positioned between said receiving recess and said foundation; and adhesive affixed to bottom surfaces of said first and second foundation attachment portions for adhering said attachment to the foundation.

2. The non-destructive device bracket assembly according to claim 1, said bracket comprising a form angle bracket.

3. The non-destructive form bracket assembly according to claim 1, said attachment device comprising an attachment plate adapted to hold said horizontally oriented raised gusset edge downward towards the foundation.

4. The non-destructive form bracket assembly according to claim 3, said attachment plate comprising an inclined portion connected to said first foundation attachment portion, a vertical portion connected to said inclined portion forming a retaining edge positioned within a triangular shaped recess, and second foundation attachment portion connected to said vertical portion such that said first and second attachment portions are oriented in a same plane.

5. The non-destructive form bracket assembly according to claim 4, wherein said attachment plate is adapted to be transversely positioned over said horizontally oriented raised gusset edge such that said retaining edge engages said raised gusset edge.

6. The non-destructive form bracket assembly according to claim 5, wherein the mounting tab formed on said horizontal supporting side fits within the triangular shaped recess without obstruction.

7. The non-destructive form bracket assembly according to claim 1, said adhesive comprising double-sided tape.

8. A form assembly for tilt-up construction comprising:

a form defining a backside face, frontside face, an upper edge and a lower edge; and a plurality of non-destructive form bracket assemblies attached to said backside face of said form and spaced apart in intervals, said bracket assemblies comprising, a bracket having a vertical supporting side and horizontal supporting side, said vertical supporting side attached to said backside face for maintaining the form vertically upright, said bracket comprising a triangular shaped gusset attached to said vertical supporting side and said horizontal supporting side, a hypotenuse side interconnecting said vertical and horizontal supporting sides, said gusset having a triangular void there through such that a horizontally oriented raised gusset edge is formed directly above said horizontal supporting side; and a mounting tab formed contiguously along each of said vertical and horizontal supporting sides, said mounting tabs oriented at right angles relative to said gusset and having a plurality of mounting holes;

an attachment device having first and second foundation attachment portions and a receiving recess being interposed therebetween, said receiving recess being adapted for engaging a portion of said bracket for non-destructively affixing said bracket to a foundation with said bracket being positioned between said receiving recess and said foundation; and adhesive affixed to bottom surfaces of said first and second foundation attachment portions for adhering said first and second foundation attachment portions to a foundation.

9. The form assembly according to claim 8, said bracket comprising a form angle bracket.

10. The form assembly according to claim 8, said attachment device comprising an attachment plate adapted to hold said horizontally oriented raised gusset edge downward towards the foundation.

11. The form assembly according to claim 10, said attachment plate comprising an inclined portion connected to said first foundation attachment portion, a vertical portion connected to said inclined portion forming a retaining edge positioned within a triangular shaped recess, said second foundation attachment portion connected to said vertical portion such that said first and second attachment portions are oriented in a same plane.

12. The form assembly according to claim 11, wherein said attachment plate is adapted to be transversely positioned over said horizontally oriented raised gusset edge such that said retaining edge engages said raised gusset edge.

13. The form assembly according to claim 12, wherein the mounting tab formed on said horizontal supporting side fits within the triangular shaped recess without obstruction.

14. The form assembly according to claim 8, said adhesive comprising double-sided tape.

15. The form assembly according to claim 8, further comprising a plurality of fasteners fastening said mounting tabs formed on said vertical supporting side to said backside face of said form.

16. The form assembly according to claim 8, wherein said adhesive is affixed to the foundation.

17. The form assembly according to claim 8, wherein said mounting tabs formed on said horizontal supporting sides rest on the foundation.

18. The form assembly according to claim 8, said form comprising conventional sized precut lumber.

19. The form assembly according to claim 18, said lumber having standard dimensions comprising one of a "1×6", "1×8", "2×6" and "2×8".

20. A method of assembling forms with a plurality of non-destructive bracket assemblies comprising a bracket comprising a triangular shaped gusset having a vertical supporting side, horizontal supporting side, and a hypotenuse side, the gusset having a triangular void disposed within the gusset such that a horizontally oriented raised gusset edge is formed directly above the horizontal supporting side, and a mounting tab formed contiguously along each of the vertical and horizontal supporting sides, the mounting tabs oriented at right angles relative to the gusset and having a plurality of mounting holes; and an attachment plate comprising a first foundation attachment portion, an inclined portion connected to the first planar foundation attachment portion, a vertical portion connected to the inclined portion forming a retaining edge and a triangular shaped recess, a second foundation attachment portion connected to the vertical portion such that the first and second attachment portions are oriented in a same plane, and adhesive attached to bottom surfaces of the first and second foundation attachment portions, the method comprising:

positioning the plurality of brackets in an upright vertical manner in spaced apart intervals alongside a backside of a form;

attaching the mounting tabs formed on the vertical supporting sides of the brackets to the backside of the form with fastening hardware;

aligning a front face of the form on a layout line;

positioning the attachment plates transversely over the raised gusset edge such that the retaining edge engages the horizontally oriented raised gusset edge; and affixing the adhesive to a top surface of a foundation.

21. The method of assembling forms according to claim 20, wherein the adhesive comprises double-sided tape.

22. The method of assembling forms according to claim 20, wherein the mounting tabs formed on said horizontal supporting sides rest on the foundation.

* * * * *